US012686475B1

(12) United States Patent
Shepherd et al.

(10) Patent No.: US 12,686,475 B1
(45) Date of Patent: Jul. 21, 2026

(54) APPARATUS AND SYSTEM FOR FLEXIBLE MEMBER DEPLOYMENT USING SABOT CONES

(71) Applicant: The United States of America, as represented by the Secretary of the Navy, Arlington, VA (US)

(72) Inventors: Stephen Shepherd, Arlington, VA (US); Damien Bretall, Bethesda, MD (US)

(73) Assignee: The United States of America, as represented by the Secretary of the Navy, Washington, DC (US)

( * ) Notice: Subject to any disclaimer, the term of this patent is extended or adjusted under 35 U.S.C. 154(b) by 429 days.

(21) Appl. No.: 18/504,241

(22) Filed: Nov. 8, 2023

(51) Int. Cl.
*B63G 8/38* (2006.01)
*B63B 21/66* (2006.01)
*B63G 8/00* (2006.01)

(52) U.S. Cl.
CPC ..... *B63G 8/38* (2013.01); *B63G 8/001* (2013.01); *B63B 21/66* (2013.01); *B63G 2008/002* (2013.01)

(58) Field of Classification Search
CPC ..... B63B 21/16; B63B 21/66; B63G 8/00; B63G 8/001; B63G 2008/002; B63G 8/38; B63G 8/39; G10K 11/00; G10K 11/004; G10K 11/006; G10K 11/008; G01S 13/917; G01S 13/937; G01S 13/956
USPC ..... 114/312, 313, 238, 239, 242, 254; 367/4
See application file for complete search history.

(56) References Cited

U.S. PATENT DOCUMENTS

| | | | | |
|---|---|---|---|---|
| 5,757,724 | A | 5/1998 | Wilson | |
| 5,757,725 | A | 5/1998 | Wilson | |
| 7,206,256 | B1 * | 4/2007 | Thornton | G01V 1/38 367/130 |
| 7,252,046 | B1 | 8/2007 | Ead | |
| 7,954,442 | B2 | 6/2011 | Stottlemyer | |
| 10,005,523 | B2 * | 6/2018 | Dudley | B63H 25/04 |
| 10,254,423 | B2 * | 4/2019 | Dudley | B63B 21/66 |
| 10,518,847 | B2 * | 12/2019 | Dudley | G01V 1/3808 |

FOREIGN PATENT DOCUMENTS

| | | |
|---|---|---|
| EP | 0432328 A1 | 6/1991 |
| GB | 2473418 A | 3/2011 |

* cited by examiner

*Primary Examiner* — Daniel V Venne
(74) *Attorney, Agent, or Firm* — Jesus J. Hernandez; U.S. Department of the Navy, Office of the General Counsel

(57) ABSTRACT

Example embodiments provide a deployment apparatus comprising a tube, a flexible member, a stopper plate, and at least one deployment stacking unit. The tube may have a diameter and having an opening into a water environment. The flexible member may have at least a portion residing within the tube and be configured to be deployed into a water environment. The stopper plate may be at the opening of the tube and be configured to allow the flexible member to deploy out of the tube. The at least one deployment stacking unit may surround the flexible member and be distributed along its length, the at least one deployment stacking unit may be configured to move about the tube. The at least one deployment stacking unit may be configured to receive an ejection force imparted on the tube, and facilitate the deployment of the flexible member out of the tube.

17 Claims, 7 Drawing Sheets

500

APPARATUS AND SYSTEM FOR FLEXIBLE MEMBER DEPLOYMENT USING SABOT CONES

STATEMENT OF GOVERNMENT INTEREST

The following description was made in the performance of official duties by employees of the Department of the Navy. The claimed subject matter, encompassing various example embodiments, may be manufactured, used, licensed by or for the United States Government for governmental purposes without the payment of any royalties thereon. Potential licensees may contact the Technology Transfer Office, NAVSEA Naval Surface Warfare Center, Carderock Division, 9500 MacArthur Ave., West Bethesda, MD 20817, USA.

FIELD

The following description relates generally to towed arrays.

BACKGROUND

According to the state of the art, thin-lined towed arrays (TLTAs) are conventionally deployed from a surface or subsurface vessel using a series of push-rollers. In such a deployment system, push-rollers may push off a flexible TLTA from a capstan winch by applying mechanical forces to the surface of the TLTA. This conventional deployment operation may cause wear and tear to a TLTA over time. In addition, the push-rollers may require maintenance over their operational life span. Approaches to address this shortcoming by adding drag have the additional fault of also increasing parasitic drag on the deployment system.

SUMMARY

Example embodiments provide a deployment apparatus comprising a tube, a flexible member, a stopper plate, and at least one deployment stacking unit. The tube may have a diameter and having an opening into a water environment. The flexible member may have at least a portion residing within the tube and be configured to be deployed into a water environment. The stopper plate may be at the opening of the tube and be configured to allow the flexible member to deploy out of the tube. The at least one deployment stacking unit may surround the flexible member and be distributed along its length, the at least one deployment stacking unit may be configured to move about the tube. The at least one deployment stacking unit may be configured to receive an ejection force imparted on the tube, and facilitate the deployment of the flexible member out of the tube.

BRIEF DESCRIPTION OF DRAWINGS

The accompanying figures are included to provide a further understanding of example embodiments, and are incorporated in and constitute part of this specification. In the figures.

DETAILED DESCRIPTION

In the following description, for purposes of explanation and not limitation, specific details are set forth such as particular structures, designs, techniques, etc., in order to provide a thorough understanding of the example embodiments. However, it will be apparent to those skilled in the art that the disclosed subject matter may be practiced in other illustrative embodiments that depart from these specific details. In some instances, detailed descriptions of well-known elements and/or method are omitted so as not to obscure the description with unnecessary detail. All principles, aspects, and embodiments, as well as specific examples thereof, are intended to encompass both structural and functional equivalents of the disclosed subject matter. Additionally, it is intended that such equivalents include both currently known equivalents as well as equivalents developed in the future.

The following description refers to flexible member deployment from a marine vessel using sabot cones. However, it should be noted that the example embodiments shown and described herein are meant to be illustrative only and not limiting in any way. As such, various modifications will be apparent to those skilled in the art for application to other fields based on technologies other than the above, which may be in various stages of development and intended for future replacement of, or use with, the above described method or apparatus.

The goal of example embodiments is to deploy a flexible member using a series of "sabot cones" to reduce mechanical forces on the system. The flexible member may be a towed array, wire rope, or other flexible cylindrical device. Example embodiments of such a deployment apparatus intend to make it easier to apply forces to a flexible member, allowing the deployment apparatus to effectively "push on a rope".

Figure 1:
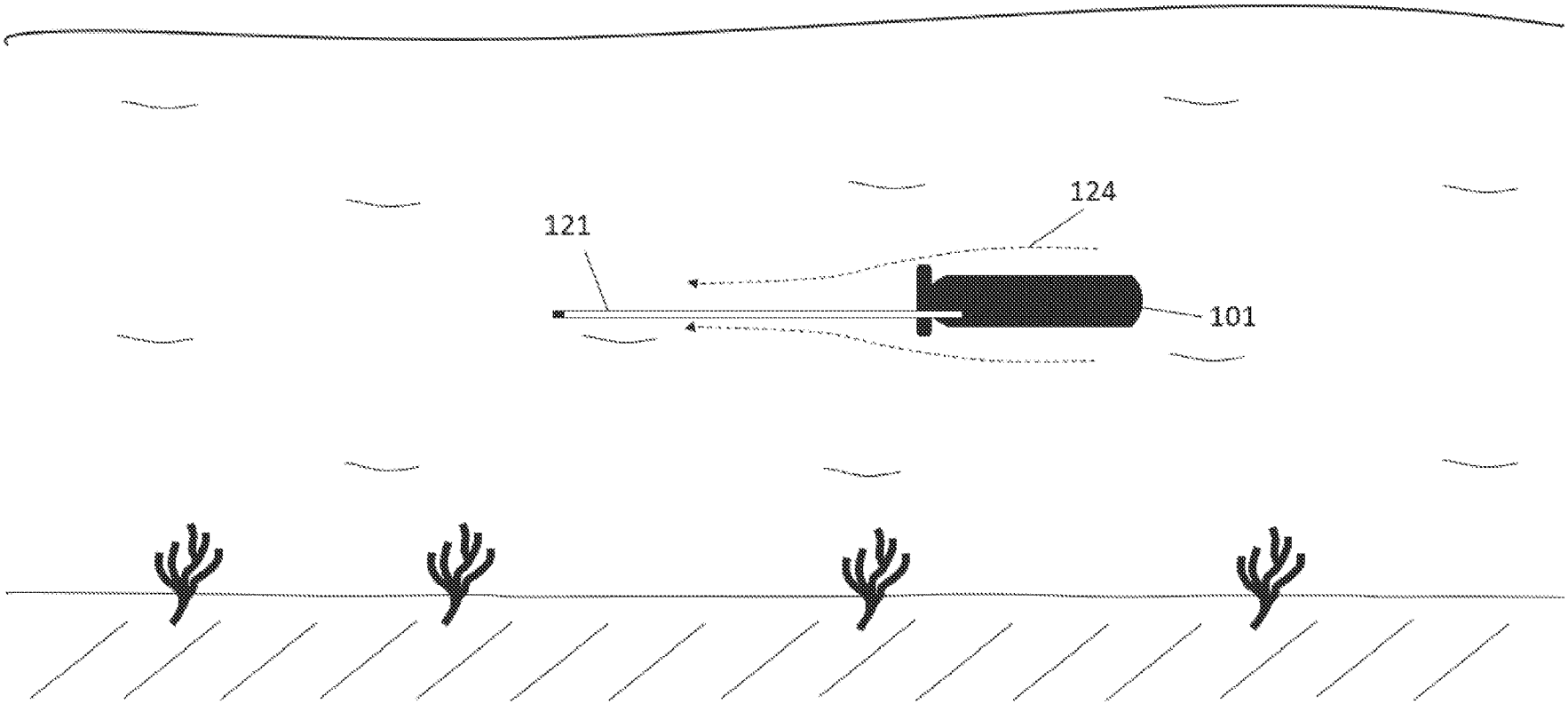
FIG. 1 is an operation of an unmanned undersea vessel (UUV) or submarine with a thin lined towed array (TLTA).

FIG. 1 depicts an operation 100 of an unmanned undersea vessel (UUV) or submarine with a TLTA. In alternative examples, the operation 100 may be undertaken in other types of marine vessels, such as a surface ship. As shown in FIG. 1, the UUV 101 may traverse an undersea environment. The undersea environment may be littoral, open-water, or deep-water. The UUV 101 may tow a flexible member. The flexible member may be a thin lined towed array (TLTA) 121. In alternative embodiments, the flexible member may be any type of array dependent on various use cases (e.g., sensing, monitoring, and/or navigating). A freestream flow may move about the UUV 101 and impact the TLTA 121. Example embodiments are directed to a deployment system for the TLTA 121 in a UUV 101. In alternative example embodiments, a deployment system may be incorporated in a manned undersea vessel or a surface vessel, rather than UUV 101.

As previously stated, conventional TLTA deployment systems, such as push-rollers, may cause undesired wear and tear to the TLTA over time. Push-rollers also require regular maintenance over time. Approaches have been developed to eliminate the need for using push-roller in a capstan assembly. Eliminating push rollers may reduce overall system maintenance costs and/or reduce mechanical forces applied to TLTAs during handling operations.

One possible approach is using an already existing force generated by the vessel to provide a requisite ejection force to deploy the TLTA. For example, the trim and drain system in an underwater vessel may be used to strategically release flushing water from a pump for the purpose of TLTA deployment. However, such an approach may generate drag from skin friction on the TLTA. Another concern with flushing water is that it would pull the TLTA off of the capstan and into the freestream flow field. Such an approach may still not generate adequate draft and still require the continued use of push rollers alongside the flushing water. Example embodiments address these concerns.

Figure 2:
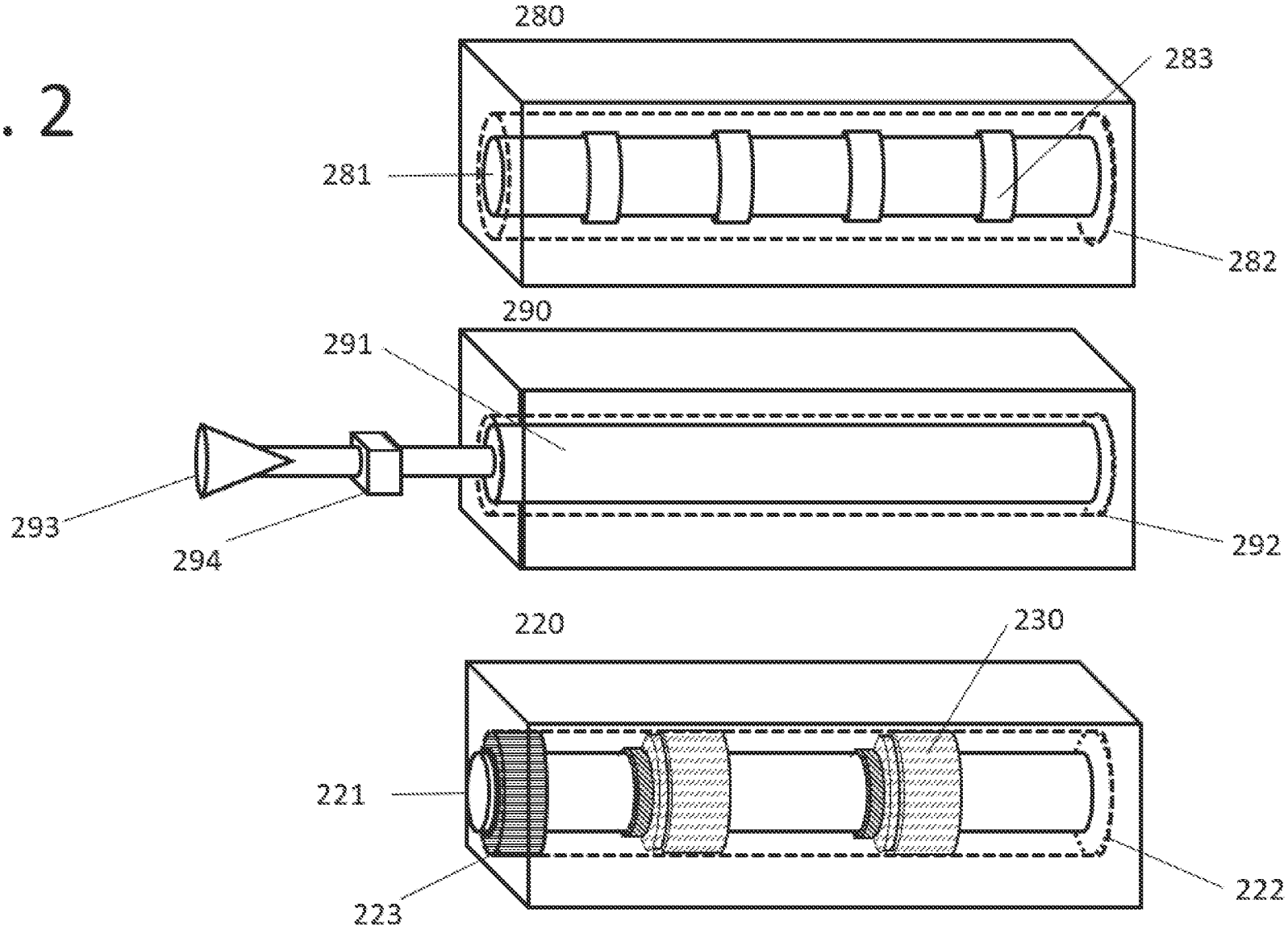
FIG. 2 is a comparison of TLTA deployment systems.

FIG. 2 is a comparison 200 of TLTA deployment systems. A first configuration 280 of a deployment apparatus is depicted. The first configuration 280 includes a TLTA 281 and TLTA tube 282. In this configuration, there are drag rings 283 to increase drag upon deployment. The drag rings 283 may be crimped onto the TLTA 281 in areas that are non-damaging to the sensitive electronics it houses.

Also depicted is a second configuration 290 of a deployment apparatus. The second configuration 290 includes a TLTA 291 and TLTA tube 292. In this configuration, there is a drogue 293 to increase drag. The drogue 293 may be either left on the TLTA 291 or detached via a quick release 294. The quick release 294 may be an acoustic release or a water-activated quick release link. Quick release 294 may be a shortcoming in the system by breaking after a set amount of time due to the corrosion caused by seawater. Both the first configuration 280 and the second configuration 290 increase undesired parasitic drag on a vessel and, therefore, are not an efficient design.

The bottom illustration is configuration 220 of a deployment apparatus, which is according to example embodiments. Configuration 220 includes a TLTA 221 and TLTA tube 222 according to example embodiments. In this configuration, there are deployment stacking units 230 and a stopper plate 223.

Configuration 220 adopts the concept of sabots from firearms to deploy TLTA 221. A sabot is a device used to fit around a projectile that is smaller than the dimensions of the bore in a firearm. A sabot keeps the projectile centered during a firing sequence and prevents the projecting force (blast wave) from bypassing the projectile. This increases the force imparted on the projectile. Upon leaving a muzzle, the sabot separates from the projectile. Configuration 220 adopts these principles (as imparted on the projectile) unto the TLTA 221 through the use of the deployment stacking units 230. As is discussed below, deployment stacking units 230 use sabot cones to facilitate deployment of the TLTA 221.

Figure 3:
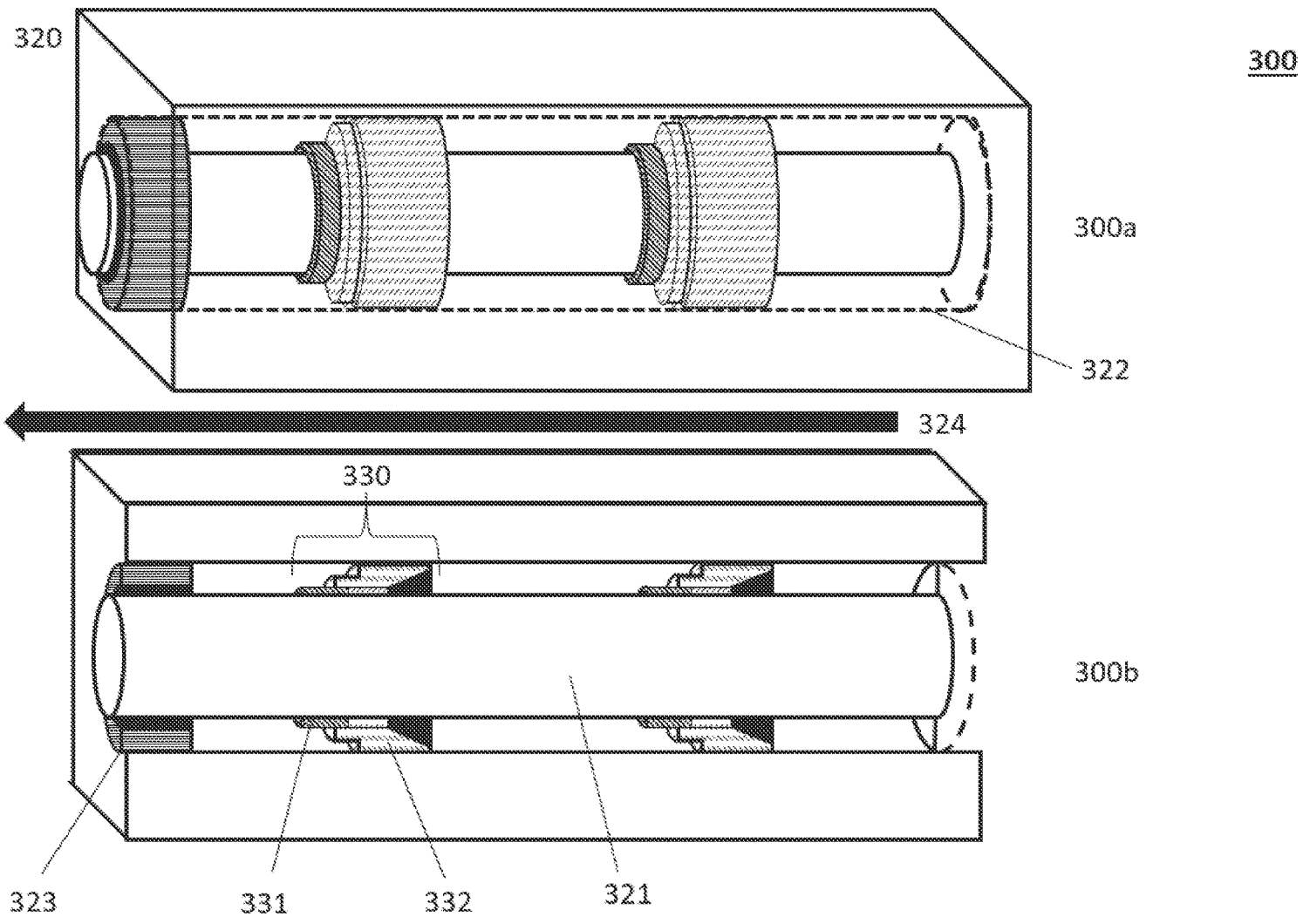
FIG. 3 is a multiple view illustration of a deployment apparatus configuration according to example embodiments.

FIG. 3 is a multiple view illustration 300 of a deployment apparatus configuration 320 according to example embodiments. More specifically, illustration 300 depicts an isometric view 300*a* and a cross-sectional view 300*b* of a deployment apparatus 320 according to example embodiments. This perspective better illustrates the constituent parts example embodiments.

Configuration 320 may include a TLTA 321 and a TLTA tube 322 according to example embodiments. The TLTA tube 322 may provide an opening through which the TLTA 321 traverses. The TLTA tube 322 may have a diameter that is wider than the diameter of the TLTA 321. In this configuration, there are deployment stacking units 330 staggered throughout TLTA 321. Configuration 320 depicts two deployment stacking units 330. Alternative example embodiments may have a single deployment stacking unit 330 or more than two deployment stacking units 330. A number of deployment stacking units 330 may be dictated by the size of the vessel, the ocean environment being traversed, or the characteristics of the TLTA 321. For instance, in cases of a very short TLTA 321, a minimal extra "push" would be all that is needed for deployment. In such a scenario, a single deployment stacking unit 330 may be used. At the end of the TLTA 321 may be a stopper plate 323, which may stack the deployment stacking units 330, whether one or more than one, during operation.

As shown in the cross-sectional view 300*b*, each deployment stacking unit 330 may comprise an array ring 331 and a sabot cone 332. Notably, each sabot cone 332 may have a prominent concave opening in the forward direction. The inner diameter of each of the sabot cones 332 may increase the further aft on the TLTA 321 it is located. Likewise, the outer diameter of each array rings 331 may increase the further aft on the TLTA 321 it is located. The array rings 331 may be fixed on the TLTA 321. The array 331 rings may be crimped onto the TLTA 321 at locations which will not damage sensitive electronics in the TLTA 321.

Configuration 320 depicts an apparatus for deploying TLTA 321 (or any similar flexible member) using deployment cones 332 by combining the ideas of flushing water, drag rings, and sabots as part of a single deployment apparatus. More specifically, a dynamic pressure from flushing water may be received by each sabot cone 332. This dynamic pressure may push against each sabot cone 332. In turn, each sabot cone 332 pushes the TLTA 321 via a force transferred to the array rings 331. Ultimately, this operation may cause the TLTA 321 to be pushed outside the TLTA tube 322. A stopper plate 323 may prevent the sabot cones 332 from exiting the TLTA tube 322 alongside the TLTA 321. The stopper plate 323 may have an opening diameter that is as wide as the largest array ring 331—which is the array ring closest in the aft direction—to permit the TLTA 321 to deploy. In this manner, the stopper plate 323 may eliminate or minimize the amount of parasitic draft to the TLTA 321 when it enters a freestream flow 324 during deployment. This is discussed in further detail in FIG. 5.

Figure 4:
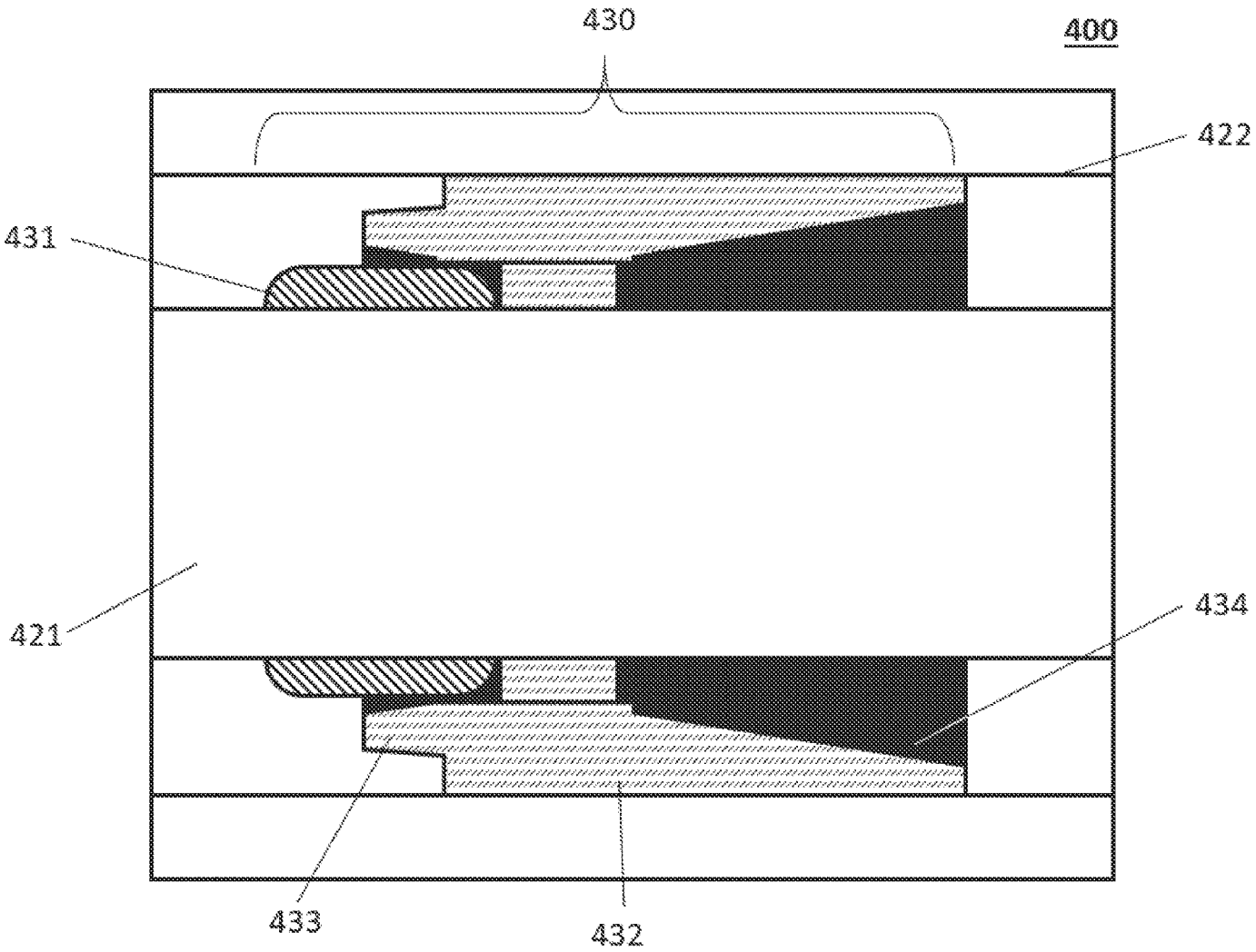
FIG. 4 is an isometric view of a deployment stacking unit in a deployment apparatus according to example embodiments.

FIG. 4 is an isometric view 400 of a deployment stacking unit in a deployment apparatus according to example embodiments. A deployment stacking unit 430 may be configured to move about the length of a tube housing the TLTA 421. The deployment stacking unit 430 may be confined to the space defined by a TLTA tube 422. The deployment stacking unit 430 may comprise an array ring 431 in the aft direction, and a sabot cone 432 in the forward direction.

With respect to the sabot cone 432, each one may have a forward concave opening 434. The inner diameter of adjacent sabot cones 432 may increase the further aft on the TLTA 421 it is placed within the TLTA tube 422. The sabot cone 432 may also have an aft concave opening 433. An array ring 431 may reside within the aft concave opening 433 prior to deployment. In this example embodiment, the aft concave opening 433 is smaller than the forward concave opening 434. Furthermore, the portion of the sabot cone 432 that corresponds with the aft concave opening 433 may have a smaller diameter than the TLTA tube 422, such that it creates a gap. This gap allows a sabot cone 432 to receive another adjacent sabot cone 432 during a deployment operation. This is discussed further in FIG. 5.

With respect to the array ring 431, an outer diameter of each array ring 431 may increase the further aft on the TLTA 321 it is placed. The array ring 431 may be fixed on the TLTA 421. The array ring 431 may be crimped onto the TLTA 421 at locations which will not damage sensitive electronics in the TLTA 421. The array ring 431 is not fixed to the sabot cone 432, such that it may separate from the sabot cone 432 during deployment of the TLTA 421.

Figure 5:
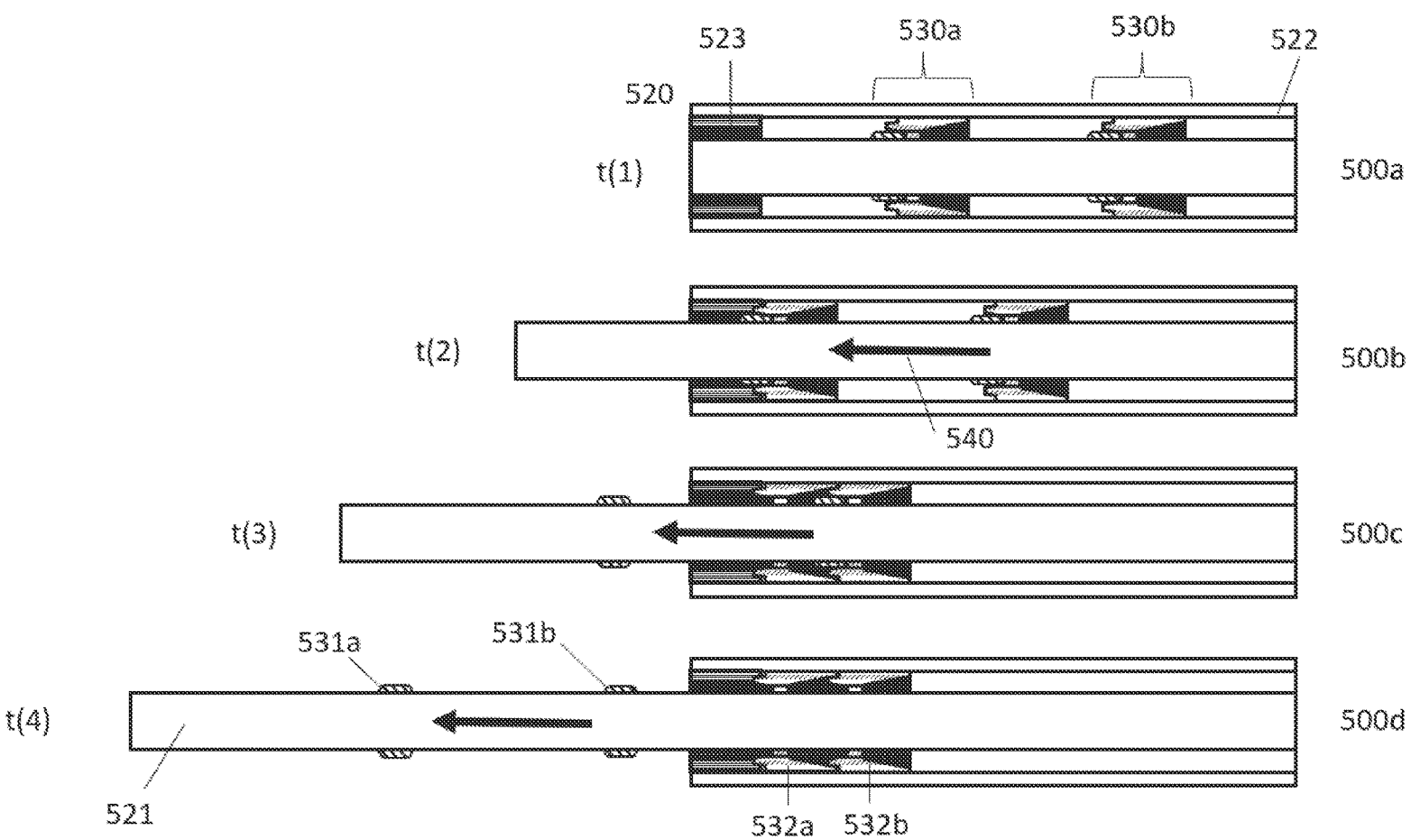
FIG. 5 is a time interval operation of a deployment apparatus according to example embodiments.

FIG. 5 is a time interval operation 500 of a deployment apparatus according to example embodiments. There are four views of deployment apparatus configuration 520, each at a different sequential time interval during deployment. A first view 500*a* corresponds with time interval t(1), a second view 500*b* corresponds with time interval t(2), a third view 500*c* corresponds with time interval t(3), and a fourth view corresponds with time interval t(4).

The configuration 520 comprises a TLTA tube 522, within which is a TLTA 521. At the end of the TLTA tube 522 is a stopper plate 523. Surrounding the TLTA 521 are a first deployment stacking unit 530*a* and a second deployment stacking unit 530*b*. The first deployment stacking unit 530*a* includes a first array ring 531*a* and a first sabot cone 532*a*. Similarly, the second deployment stacking unit 530*b* includes a second array ring 531*b* and a second sabot cone 532*b*.

The first view 500*a* depicts the configuration 520 at a rest state during time interval t(1). In this rest state, there is no ejection force on the TLTA 521. The first deployment stacking unit 530*a* and the second deployment stacking unit 530*b* are also in their rest locations. The location of the first deployment stacking unit 530*a* and the second deployment stacking unit 530*b* are dictated by the location of their respective array rings 531*a*, 531*b* in the TLTA 521. As previously stated, the first array ring 531*a* and the second array ring 531*b* may be crimped onto the TLTA 521 at locations which will not damage its sensitive electronics.

At time interval t(2), an ejection force 540 in the aft direction may be provided on the configuration 520 along the axis of the TLTA tube 522. The ejection force 540 may be captured by the sabot cones 532*a*, 532*b*. As the ejection force 540 is provided on the configuration 520, the TLTA 521 begins deployment by exiting the TLTA tub 522. At time interval t(2), the first deployment stacking unit 530*a* has reached the stopper plate 522.

The ejection force 540 may be generated through a variety of operations, some of them dependent on the type of vessel in which the configuration 520 is incorporated. In some example embodiments, the ejection force 540 may be generated via the trim and drain system of an underwater vessel. More specifically, a flushing operation by the trim and drain system may provide the requisite ejection force 540. In other example embodiments, the pressure of a submerged underwater vessel may be used to generate an air blast operation and provide the requisite ejection force 540. In still other examples, a standalone water or air pump may provide the ejection force 540. This is discussed further in FIG. 6.

At time interval t(3), the ejection force 540 continues to deploy an additional portion of the TLTA 521. Notably, at this time, the constituent parts of the first deployment stacking unit 530*a* are separated. More specifically, the first array ring 531*a* has moved outside of the TLTA tube 522 alongside with the TLTA 521. However, the first sabot cone 532*a* is estopped by the stopper plate 523. In addition, at this point in time, the second deployment stacking unit 530*b* has reached the first sabot cone 532*a*. Time interval t(3) illustrates the first sabot cone 532*a* and the second sabot cone 532*b* "stacking" upon each other.

Finally, at time interval t(4), the ejection force 540 has expelled a substantial portion of the TLTA 521 from the TLTA tube 522, alongside each of the first array ring 531*a* and the second array ring 532*b*. In addition, both the first sabot cone 532*a* and the second sabot cone 532*b* are stacked upon each other at the stopper plate 523.

The ejection force 540 deployed within the TLTA tube 522 may also act on the first and second array rings 531*a*, 531*b* once outside of the TLTA tube 522 to pull the TLTA 521 into a freestream flow field. At the same time, parasitic drag may be minimized by the stopper plate 522 by preventing the first and second sabot cones 530*a*, 530*b* from entering the freestream flow field.

In alternative embodiments, operation 500 may be applied to a minimum necessary length of the TLTA 521 that will permit the freestream flow to provide enough drag to generate an complementary ejection force alongside the ejection force 540 provided by the vessel. In yet another alternative embodiment, the ejection force 540 may be calibrated to only be sufficient to deploy the TLTA 521 from within the TLTA tube 522, and thereafter allow the freestream flow to generate the complementary ejection force.

During recovery of the TLTA 521, the first and second array rings 531*a*, 531*b* may impact the corresponding first and second sabot cones 532*a*, 532*b*, respectively. In particular, the different radius of the first and second array rings 531*a*, 531*b* along the aft directions allows each ring to pull their respective stacking cones apart and reset the system. Alternatively, if recovery is not required, the first and second sabot cones 532*a*, 532*b* may be designed to separate from the TLTA 521 after deployment.

With respect to storage, the first and second sabot cones 532*a*, 532*b* may be placed and stored in the TLTA tube 522 or in a TLTA winch (thereby facilitating the addition of more cones to the system). Alternatively, if storage is not desired, the entire TLTA 522 can be disconnected from the vessel after use.

The first and second deployment stacking units 530*a*, 530*b* may be made of any material that would reduce any biofouling that may occur to prevent the system from jamming. The material may be a high density plastic, such as high density polyethylene (HDPE). The material should avoid placing excessive pressure on the TLTA 521. The first and second deployment stacking units 530*a*, 530*b* may be manufactured on the TLTA 521. In alternative embodiments, the first and second deployment stacking units 530*a*, 530*b* may be removable units that may be manually added to the TLTA 521 as needed. This may be accomplished by dividing a single deployment stacking unit into two half-moon configurations that can be clamped around a TLTA 521.

Advantages of the deployment operation 500 include reducing, but not eliminating, drag to the TLTA 521 when it enters into the freestream flow field. The drag generating configuration 520 may also reset itself upon recovery of the TLTA 521 and may be redeployed for several launch and recovery cycles. The drag generating configuration 520 may limit exertion of mechanical forces to areas of the TLTA 521 that are reinforced and capable of withstanding loads. This is an improvement on push rollers, which may act on the entire length of the TLTA 521. Applying the ejection force 540 to the array rings 531*a*, 531*b* may minimize the chance of buckling or overbending the TLTA 521 in the event of a jam.

Figure 6:
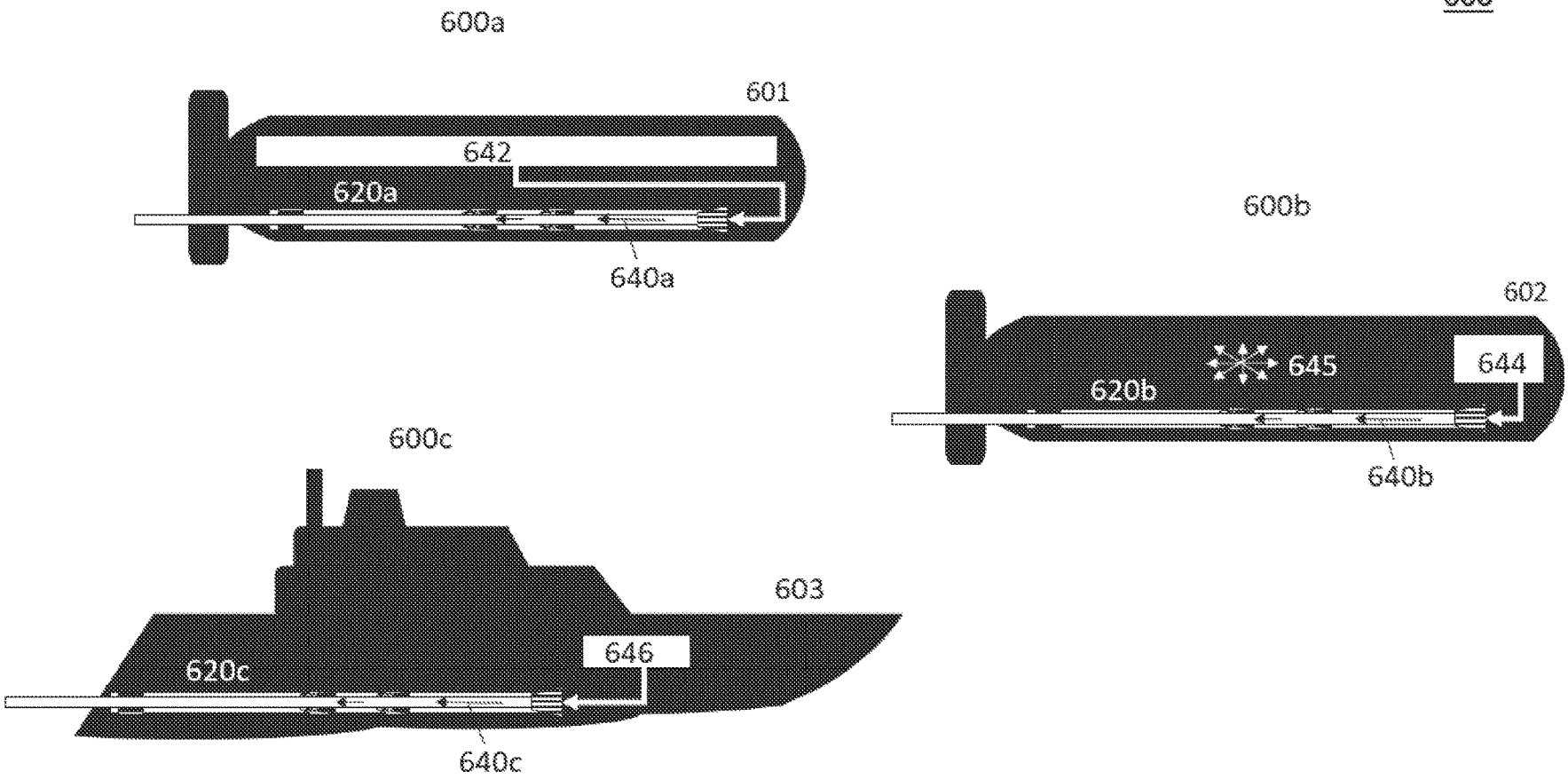
FIG. 6 depicts implementations of a deployment system configuration according to example embodiments.

FIG. 6 depicts implementations 600 of a deployment system configuration according to example embodiments. The various implementations 600 include: a flush-based configuration 600*a* in an underwater vessel; an "air blast"- based configuration 600*b* in an underwater vessel; and a pump-based configuration 600*c* in a surface vessel.

The flush-based configuration 600*a* may be incorporated into an underwater vessel 601. The underwater vessel 601 may be a UUV. The underwater vessel 601 may include a deployment apparatus configuration 620*a* and a trim and drain system 642. The trim and drain system 642 may control the buoyancy of the underwater vessel 601. As part of this control, the trim and drain system 642 may flush water out to the surrounding environment. This feature is leveraged to provide an ejection force 640*a*. More specifically, flushing water from the trim and drain system 642 is fed to the deployment apparatus configuration 620*a* to provide the ejection force 640*a* for deployment of a TLTA.

The "air blast"-based configuration 600*b* may be incorporated into an underwater vessel 602. The underwater vessel 602 may be an UUV, or other pressure vessel. The underwater vessel 602 may include a deployment apparatus configuration 620*b* and a pressure controller 644. The pressure controller 644 is used in closed system environments subject to an internal pressure 645. The pressure controller 644 may be used to generate an air blast by increasing the pressure in the underwater vessel 602. The air blast may be fed to the drag generating configuration 620*b* to provide an ejection force 640*b* for deployment of the TLTA.

In contrast to the flush-based configuration 600*a*, the "air blast"-based configuration 600*b* may minimize water from rushing back into the underwater vessel 602 during deployment. More specifically, a TLTA reel may be stored in a dry pressurized section and a container of compressed gas (e.g., air, nitrogen) could be activated to increase pressure. A hatch in the deployment apparatus configuration 620*b* may open and may provide the ejection force 640*b* to the deployment stacking units to propel the TLTA outward and out of the underwater vessel 602.

To prevent water from rushing in, a pressure bulkhead seal could be implemented at a TLTA exit point of the underwater vessel 602, or at whichever boundary best suits a design. Alternatively, once the TLTA is fully deployed, there could be an oversized cone at the end that would seal off the TLTA tube and prevent water in-rush. This approach may also facilitate depressurization in the pressure hull.

Retrieval of the TLTA in an "air blast"-based configuration 600*b* may include: (i) TLTA detachment and floating to the surface; (ii) TLTA detachment and discarding (sink and/or float); and/or (iii) rapid TLTA reeling during pressure hull over-pressurizing to keep the water out. Depending on the length and rigidity of the TLTA or other flexible member, a reel may not even be necessary.

Finally, the pump-based configuration 600*c* may be incorporated into a surface vessel 603. The surface vessel 603 may include a pump system 646. The pump system 646 may be connected to a ballast tank of a surface ship, or be a standalone water or air pump. The pump system 646 may be any system that pumps water or air out of the surface vessel 603. The deployment apparatus configuration 620*c* incorporates the pump system 646 to provide an ejection force 640*c*.

Figure 7:
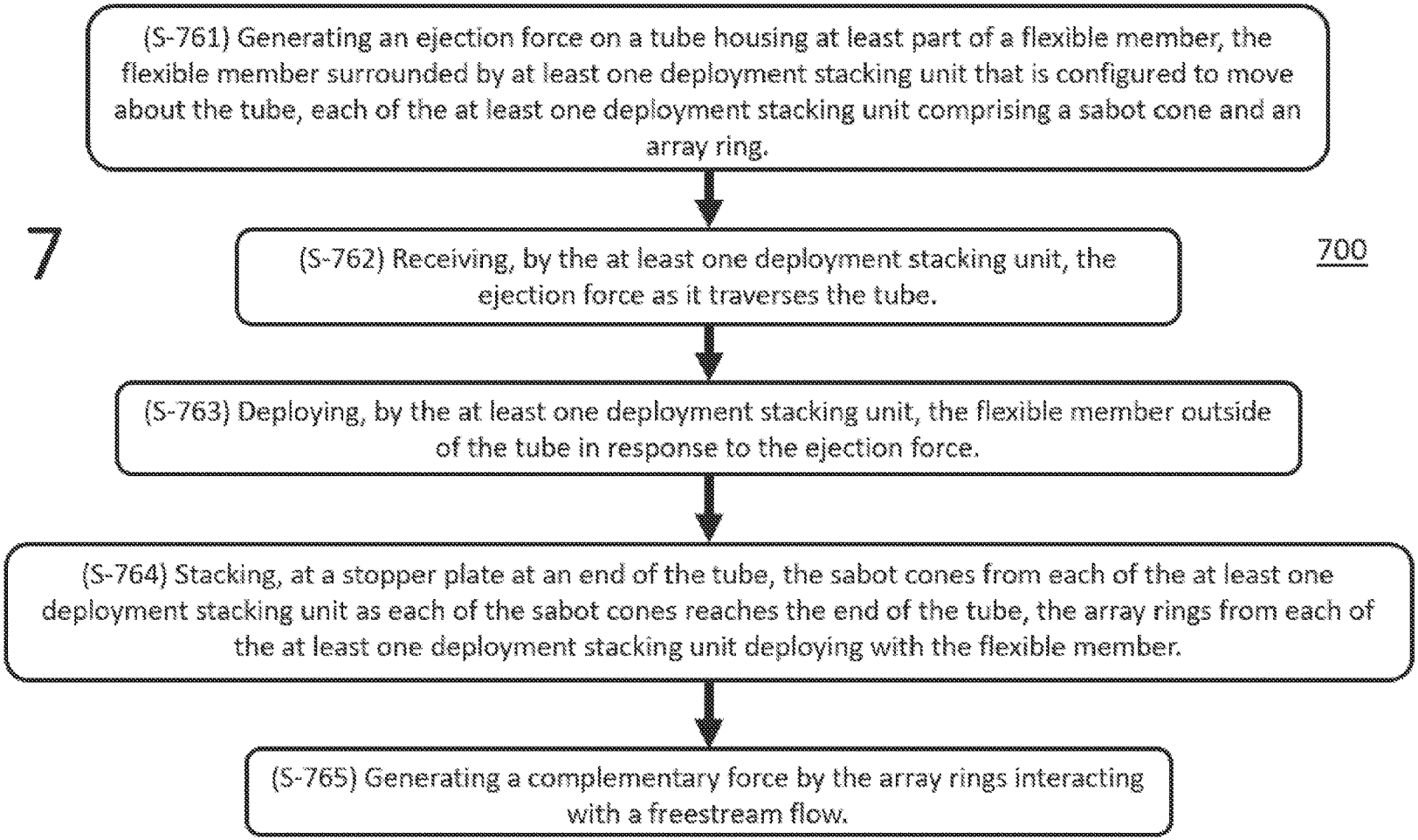
FIG. 7 is a deployment method according to example embodiments.

FIG. 7 is a deployment method 700 according to example embodiments. In an initial step (S-761) an ejection force is generated on a tube housing at least part of a flexible member. The flexible member may be surrounded by at least one deployment stacking unit that is configured to move about the tube, each of the at least one deployment stacking unit comprising a sabot cone and an array ring. Thereafter, the at least one deployment stacking unit may (S-762) receive the ejection force as it traverses the tube. The next step is (S-763) deploying by the at least one deployment stacking unit, the flexible member outside of the tube in response to the ejection force. A stopper plate then (S-764) stacks the sabot cones from each of the at least one deployment stacking unit as each of the sabot cones reaches the end of the tube. The array rings from each of the at least one deployment stacking unit deploy with the flexible member. Finally, (S-765) a complementary force is generated by the array rings interacting with a freestream flow.

The example embodiments being thus described, it will be obvious that the same may be varied in many ways. Such variations are not to be regarded as a departure from the disclosed subject matter, and all such modifications are intended to be included within the scope of the disclosed subject matter.

What is claimed is:

1. A deployment apparatus comprising:

a tube having a diameter and having an opening into a water environment;

a flexible member having at least a portion residing within the tube and configured to be deployed into a water environment;

a stopper plate at the opening of the tube and configured to allow the flexible member to deploy out of the tube; and at least one deployment stacking unit surrounding the flexible member and distributed along a length of the flexible member, the at least one deployment stacking unit configured to move about the tube, wherein the at least one deployment stacking unit is configured to receive an ejection force imparted on the tube, and in response facilitate the deployment of the flexible member out of the tube.

2. The deployment apparatus of claim 1, each of the at least one deployment stacking unit comprising:

a sabot cone configured to move along an axis defined by the flexible member, the sabot cone having an aft concave opening and a forward concave opening, wherein the forward concave opening is greater than the aft concave opening, an array ring fixed on the flexible member and configured to reside within the aft concave opening of the sabot cone during a rest position.

3. The deployment apparatus of claim 2, wherein the forward concave opening of the sabot cone is configured to receive the ejection force and deploy the flexible member out the tube, wherein sabot cones of each the at least one deployment stacking unit is configured to stack on each other as the flexible member deploys out the tube.

4. The deployment apparatus of claim 3, wherein the sabot cones are configured to stack at the stopper plate as the flexible member deploys from the tube, wherein each array ring deploys alongside the flexible member from the tube, wherein the each array ring is configured to generate drag with a freestream flow as the array ring exits the tube.

5. The deployment apparatus of claim 3, wherein an outer diameter of each array ring increases further in an aft direction of the flexible member, wherein an inner diameter of each sabot cone increases further in the aft direction of the flexible member.

6. The deployment apparatus of claim 1, further comprising:

an ejection force unit configured to provide the ejection force in the tube to deploy the flexible member.

7. The deployment apparatus of claim 1, wherein the flexible member is a towed array.

8. The deployment apparatus of claim 7, wherein the towed array is a thin lined towed array.

9. A deployment system comprising:

a vessel configured to navigate in a water environment;

a deployment apparatus housed in the vessel, the deployment apparatus comprising, a tube having a diameter and having an opening into a water environment;

a flexible member having at least a portion residing within the tube and configured to be deployed into a water environment;

a stopper plate at the opening of the tube and configured to allow the flexible member to deploy out of the tube; and at least one deployment stacking unit surrounding the flexible member and distributed along a length of the flexible member, the at least one deployment stacking unit configured to move about the tube; and an ejection force unit configured to provide an ejection force on the tube to deploy the flexible member, wherein the at least one deployment stacking unit is configured to receive the ejection force and, in response, facilitate deployment of the flexible member out of the tube.

10. The deployment system of claim 9, each of the at least one deployment stacking unit comprising:

a sabot cone configured to move along an axis defined by the flexible member, the sabot cone having an aft concave opening and a forward concave opening, wherein the forward concave opening is greater than the aft concave opening, an array ring fixed on the flexible member and configured to reside within the aft concave opening of the sabot cone during a rest position.

11. The deployment system of claim 10, wherein the forward concave opening of the sabot cone is configured to receive the ejection force and deploy the flexible member out the tube, wherein sabot cones of each the at least one deployment stacking unit is configured to stack on each other as the flexible member deploys out the tube.

12. The deployment apparatus of claim 9, wherein the ejection force unit is associated with a trim and drain system of the vessel, such that the ejection force is flushing water that is received by the at least one deployment stacking unit.

13. The deployment apparatus of claim 9, wherein the ejection force unit is associated with a compressed gas container of the vessel, such that the ejection force is an air blast that is received by the at least one deployment stacking unit.

14. The deployment apparatus of claim 9, wherein the ejection force unit is associated with a pump of the vessel, such that the ejection force is pumped water or air that is received by the at least one deployment stacking unit.

15. The deployment system of claim 9, wherein the vessel is one of a surface vessel and an underwater vessel.

16. The deployment system of claim 9, wherein the vessel is an unmanned underwater vessel.

17. A deployment method comprising:

generating an ejection force on a tube housing at least part of a flexible member, the flexible member surrounded by at least one deployment stacking unit that is configured to move about the tube, each of the at least one deployment stacking unit comprising a sabot cone and an array ring;

receiving, by the at least one deployment stacking unit, the ejection force as the at least one deployment stacking unit traverses the tube;

deploying, by the at least one deployment stacking unit, the flexible member outside of the tube in response to the ejection force;

stacking, at a stopper plate at an end of the tube, the sabot cones from each of the at least one deployment stacking unit as each of the sabot cones reaches the end of the tube, the array ring from each of the at least one deployment stacking unit deploying with the flexible member; and generating a complementary force by the array ring from each of the at least one deployment stacking unit interacting with a freestream flow.

* * * * *